US011867190B2

(12) United States Patent
Sinico et al.

(10) Patent No.: US 11,867,190 B2
(45) Date of Patent: Jan. 9, 2024

(54) VERTICAL ELECTRIC PUMP HAVING INSTRUMENTS FOR CONTROL AND MONITORING THE OPERATION OF THE PUMP ACCESSIBLE FROM A SINGLE SIDE OF THE PUMP

(71) Applicant: DAB PUMPS S.P.A., Mestrino (IT)

(72) Inventors: Francesco Sinico, Montecchio Maggiore (IT); Stefano Tazioli, Localita' Gabbro (IT); Sara Lucia, Bientina (IT)

(73) Assignee: DAB PUMPS S.P.A., Mestrino (IT)

( * ) Notice: Subject to any disclaimer, the term of this patent is extended or adjusted under 35 U.S.C. 154(b) by 179 days.

(21) Appl. No.: 17/195,930

(22) Filed: Mar. 9, 2021

(65) Prior Publication Data

US 2021/0277907 A1 Sep. 9, 2021

(30) Foreign Application Priority Data

Mar. 9, 2020 (IT) ..... 102020000004879

(51) Int. Cl.
*F04D 27/00* (2006.01)
*F04D 13/06* (2006.01)
(Continued)

(52) U.S. Cl.
CPC ..... *F04D 27/001* (2013.01); *F04D 13/06* (2013.01); *F04D 13/16* (2013.01); *F04D 29/007* (2013.01); *F04D 29/043* (2013.01); *F04D 29/406* (2013.01); *F04D 1/06* (2013.01); *F04D 1/063* (2013.01); *F04D 29/42* (2013.01); *F04D 29/445* (2013.01)

(58) Field of Classification Search
CPC ..... F04D 29/007; F04D 15/083; F04D 29/62; F04D 29/42; F04D 15/0083
See application file for complete search history.

(56) References Cited

U.S. PATENT DOCUMENTS 9,568,005 B2 * 2/2017 Robol ..... E04H 4/1245
2006/0251531 A1 * 11/2006 Favella ..... F04D 13/16 417/423.3

(Continued)

FOREIGN PATENT DOCUMENTS

JP 2009-270462 A 11/2009

OTHER PUBLICATIONS

JP2009270462machiinetranslation; Escapenet.com, Sep. 13, 2023. (Year: 2023).*

(Continued)

*Primary Examiner* — Nathan C Zollinger
*Assistant Examiner* — Timothy P Solak
(74) *Attorney, Agent, or Firm* — Maier & Maier, PLLC

(57) ABSTRACT

A vertical electric pump for moving a liquid, that includes a containment jacket a mechanical section, which includes an intake port and a delivery port, an assembly for the movement of the liquid which includes one or more impellers, spaced out by diffusers and keyed on a driving shaft, an electromechanical section, which includes an electric motor having a rotor and a stator that surrounds the rotor, the rotor being keyed on the driving shaft, and a set of instruments for the control and monitoring of its operation accessible from a single side of the electric pump.

11 Claims, 2 Drawing Sheets

(51) Int. Cl.

| | |
|---|---|
| ***F04D 13/16*** | (2006.01) |
| ***F04D 29/00*** | (2006.01) |
| ***F04D 29/043*** | (2006.01) |
| ***F04D 29/40*** | (2006.01) |
| *F04D 29/42* | (2006.01) |
| *F04D 1/06* | (2006.01) |
| *F04D 29/44* | (2006.01) |

(56) References Cited

U.S. PATENT DOCUMENTS

| | | | | |
|---|---|---|---|---|
| 2011/0223038 | A1* | 9/2011 | Ogawa | F04D 15/0066 417/45 |
| 2014/0093409 | A1* | 4/2014 | Tazioli | F04D 1/066 417/423.11 |
| 2014/0241921 | A1* | 8/2014 | Tazioli | F04D 1/006 415/182.1 |
| 2017/0108007 | A1 | 4/2017 | Sierakowski-Larsen | |
| 2017/0114790 | A1* | 4/2017 | Pohler | F04D 29/426 |
| 2018/0258938 | A1* | 9/2018 | Mikkelsen | H02K 11/35 |

OTHER PUBLICATIONS

Italian Search Report dated Nov. 2, 2020 received in Italian Application No. IT 2020000004879, together with an English-language translation.

* cited by examiner

VERTICAL ELECTRIC PUMP HAVING INSTRUMENTS FOR CONTROL AND MONITORING THE OPERATION OF THE PUMP ACCESSIBLE FROM A SINGLE SIDE OF THE PUMP

CROSS-REFERENCE TO PRIORITY APPLICATION

The disclosures in Italian Patent Application No. 102020000004879 from which this application claims priority are incorporated herein by reference.

The present invention relates to a vertical electric pump.

An electric pump is an apparatus for moving a liquid, generally water, by drawing it from a first region, by means of an intake duct, and sending it into a second region by means of a delivery duct.

The electric pump comprises an external containment jacket which encloses inside it:

- a mechanical section, which comprises an intake port and a delivery port, to which the intake and delivery ducts are connected, and contains one or more impellers, interleaved by diffusers keyed on a driving shaft adapted to rotate them, for the movement of the liquid,
- an electromechanical section, comprising an electronic board for the control of the electric pump and an electric motor, contained in a shell and comprising in turn a rotor, from which the driving shaft extends, and a stator which surrounds said rotor.

In the present description, the expression "vertical electric pump" is understood to mean an electric pump that has a vertical configuration for use and a vertical axis of extension, with the mechanical section in its lower part and the electromechanical section in its upper part, which lies above the mechanical section.

A vertical electric pump usually has an expansion tank and a set of instruments for the control and monitoring of the operation of the electric pump, comprising, for example:

- a user interface,
- one or more pressure sensors,
- a one-way valve (OWV) which is fluidically interposed between the delivery port and the expansion tank.

This background art has some drawbacks.

This expansion tank and the elements that compose said set of instruments are usually arranged in different locations and/or sides of the electric pump, even mutually opposite, and are not always easily and quickly accessible and/or visible if needed and/or for maintenance.

This leads to long and awkward maintenance operations.

Another drawback is tied to the fact that since these elements are arranged in different locations and/or sides of the electric pump, which are not always easily accessible and/or visible, the user needs to remember where the element of interest is located and/or retrieve this information from the manual of the electric pump, before he can perform any operation.

This leads to longer maintenance times and, consequently, similar times of interruption of the operation of the electric pump.

Furthermore, the arrangement of the expansion tank and of the elements of the set of instruments for the control and monitoring of the operation of the electric pump arranged in different locations and/or sides thereof leads to the generation of considerable space occupations.

The aim of the present invention is to provide a vertical electric pump that is capable of improving the background art in one or more of the above mentioned aspects.

Within this aim, an object of the invention is to provide a vertical electric pump that has an expansion tank and elements of the set of instruments for the control and monitoring of its operation which are easily and quickly accessible.

Another object of the invention is to provide a vertical electric pump that, if needed, does not require the user to remember/find information concerning the location of the tank and/or of the elements of the set of instruments for the control and monitoring of its operation.

Another object of the invention is to provide a vertical electric pump that has a smaller space occupation than similar electric pumps of the known type.

A further object of the present invention is to overcome the drawbacks of the background art in a manner that is alternative to any existing solutions.

Another object of the invention is to provide a vertical electric pump that is highly reliable, relatively easy to provide and at competitive costs.

This aim and these and other objects which will become better apparent hereinafter are achieved by a vertical electric pump, for the movement of a liquid, which comprises a containment jacket which encloses inside it:

- a mechanical section, which comprises an intake port and a delivery port, said mechanical section containing an assembly for the movement of said liquid which comprises one or more impellers, interleaved by diffusers and keyed on a driving shaft,
- an electromechanical section, comprising an electric motor, comprising in turn a rotor and a stator that surrounds said rotor, said rotor being keyed on said driving shaft,
- said electric pump comprising a set of instruments for the control and monitoring of its operation,
- said electric pump being characterized in that said set of instruments for the control and monitoring of its operation is accessible entirely from a single side of said electric pump.

Further characteristics and advantages of the invention will become better apparent from the description of a preferred but not exclusive embodiment of the vertical electric pump according to the invention, illustrated by way of non-limiting example in the accompanying drawings, wherein:

DETAILED DESCRIPTION OF THE DISCLOSURE

Figure 1:
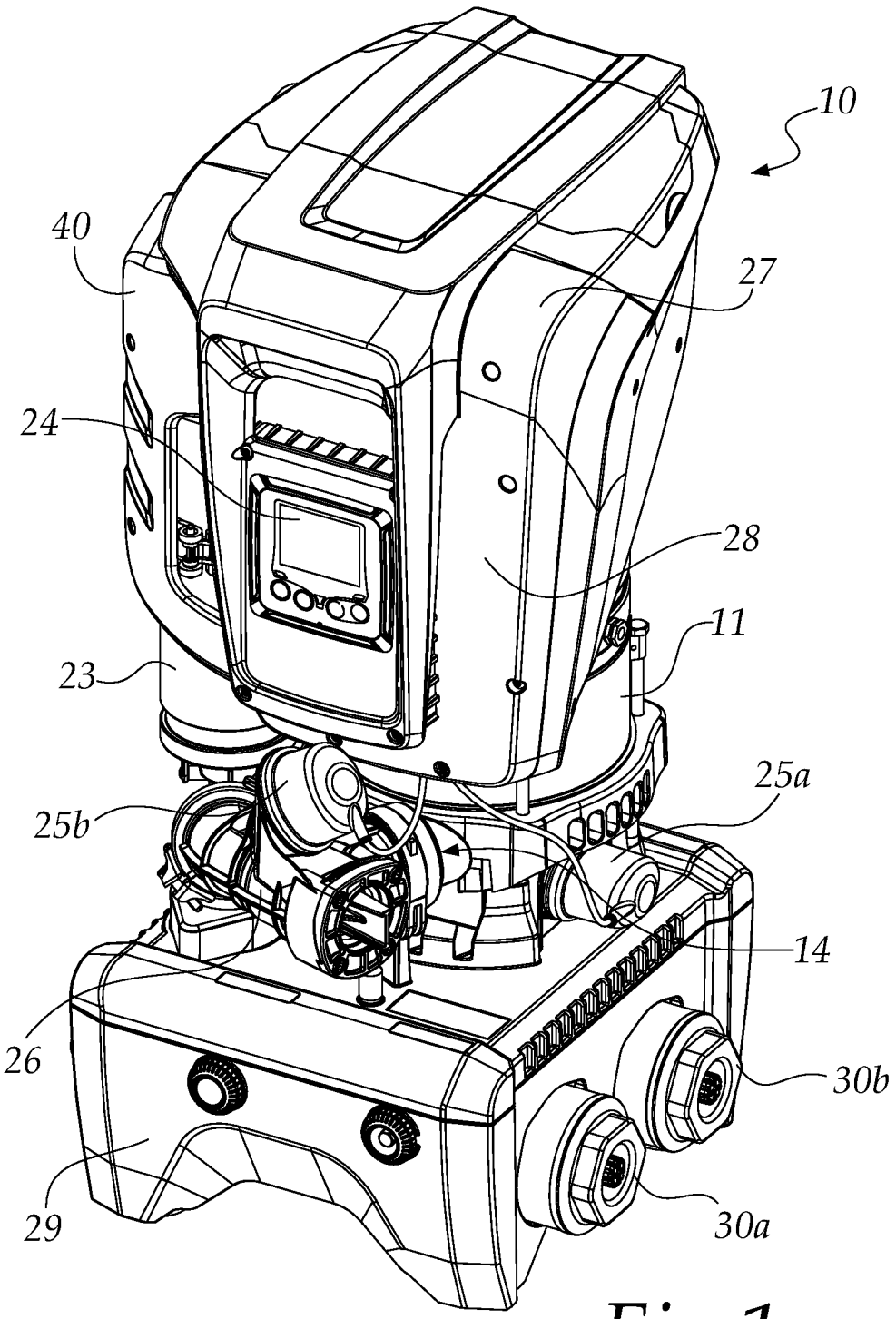
FIG. 1 is a general perspective view of a vertical electric pump according to the invention.
Figure 2:
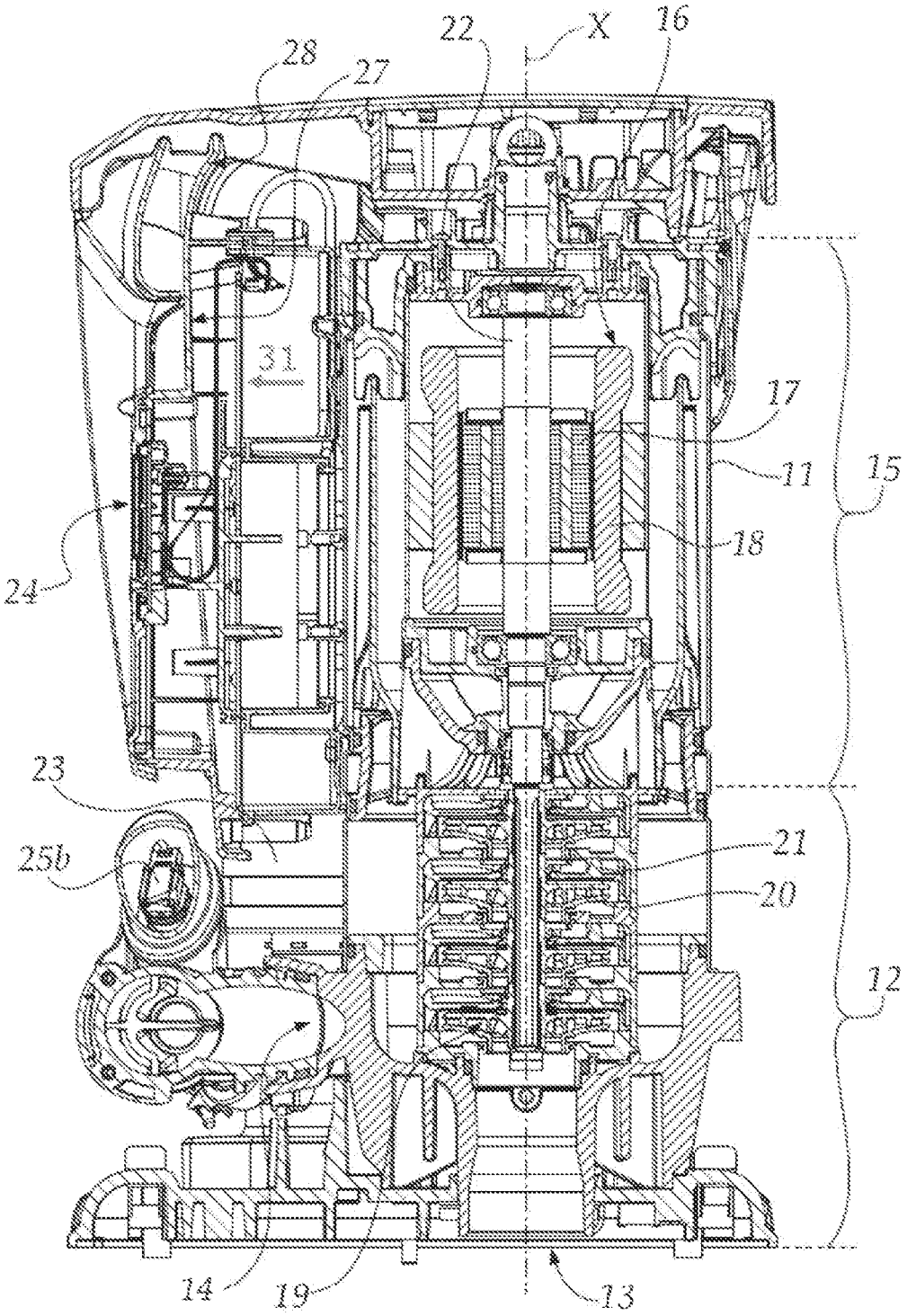
FIG. 2 is a sectional view of a portion of the vertical electric pump of FIG. 1.

With reference to the figures, a vertical electric pump for moving a liquid, according to the invention, is generally designated by the reference numeral 10.

The electric pump 10 comprises a containment jacket 11 which encloses inside it:

- a mechanical section 12, which comprises an intake port 13 and a delivery port 14,
- an electromechanical section 15, comprising an electric motor 16, comprising in turn a rotor 17 and a stator 18 which surrounds the rotor 17.

The mechanical section 12 comprises an assembly 19 for moving the liquid which comprises one or more impellers 20, interleaved by diffusers 21 and keyed on a driving shaft 22.

In another embodiment, not shown in the figures, the electric pump has a single impeller. In this case, the diffuser is not present, since it is not necessary.

The rotor 17 of the motor 16 is also keyed on the driving shaft 22.

The jacket 11 has a substantially cylindrical shape.

The driving shaft 22 has an axis of extension which is parallel to the axis of extension of the electric pump 10 and coincides substantially with the axis of extension X of the jacket 11.

The intake port 13 has an axis of extension which substantially coincides with the axis of extension X of the jacket 11.

The electric pump 10 comprises an expansion tank 23 and a set of instruments for the control and monitoring of operation.

The expansion tank 23 is adapted to absorb any so-called water hammers and has a substantially cylindrical shape and an axis of extension that is parallel to the axis of extension X of the jacket 11.

The set of instruments for the control and monitoring of the operation of the electric pump 10 comprises one or more operating elements, including:

- a user interface 24,
- and/or one or more pressure sensors 25*a*, 25*b*,
- and/or a one-way valve (OWV) 26 which is fluidically interposed between the delivery port 14 and the expansion tank 23.

In the embodiment shown in FIG. 1, the electric pump 10 comprises two pressure sensors:

- a first pressure sensor 25*a*, which is fluidically connected to the intake port 13,
- a second pressure sensor 25*b*, which is fluidically connected to the delivery port 14.

One of the particularities of the electric pump 10 resides in that the set of instruments for the control and monitoring of its operation is accessible entirely from a single side of the electric pump 10.

Likewise, the expansion tank 23 is also accessible from the same side of the electric pump 10 from which the set of instruments for control and monitoring is accessible.

Furthermore, the set of instruments for the control and monitoring of the operation of the electric pump 10 and the expansion tank 23 are completely visible from a single side of the electric pump 10 which coincides with the side from which they are accessible.

All the elements of the set of instruments for control and monitoring and the expansion tank 23 are arranged substantially on the same side of the electric pump 10, substantially at/proximate to a side of the lateral surface of the jacket 11.

This allows the user quick and easy access to the elements of the set of instruments for control and monitoring and to the expansion tank 23, and from a single side.

In this manner, in order to ensure easy and quick maintenance for the user it is sufficient to install the electric pump 10 with only one side accessible, the one provided with the set of instruments for the control and monitoring of the operation of the electric pump 10.

Furthermore, such an arrangement of the elements of the set of instruments for the control and monitoring of the operation of the electric pump 10 and of the expansion tank 23 allows to reduce the overall space occupations of the electric pump 10 with respect to similar electric pumps of a known type.

In particular, the electric pump 10 comprises:

- a shell 27 made of plastic material, which contains at least partially the upper portion of the jacket 11,
- an enclosure 40 made of plastic material, which contains at least partially the upper portion of the expansion tank 23.

The enclosure 40 is laterally adjacent to the shell 27.

The expansion tank 23 is easily removable from the electric pump 10 after the enclosure 40 has been removed.

The shell 27 is associated with the lateral surface of the jacket 11 and has a substantially flat surface 28 which is parallel to the axis of extension X of the jacket 11.

The user interface 24 is accommodated in this surface 28 and is also substantially flat and parallel to the axis of extension X of the jacket 11.

The electric pump 10 comprises an electronic board 31 to which the pressure sensors 25*a*, 25*b* and the user interface 24 are connected.

The electronic board 31 is contained inside the shell 27 and is substantially parallel to the user interface 24.

The electric pump 10 is provided with a footing 29, below the jacket 11, which comprises two parallel manifolds 30*a*, 30*b* adapted to be connected fluidically to the hydraulic system in which the electric pump 10 is applied, not shown in the figures:

- a first manifold 30*a*,
- a second manifold 30*b*.

The first manifold 30*a* is connected fluidically to the delivery port 14 while the second manifold 30*b* is connected fluidically to the intake port 13.

The axis of extension of the second manifold 30*b* is at right angles to the axis of extension X of the jacket 11.

The axis of extension of each manifold is substantially parallel to the surface 28 of the shell 27; in this manner no space occupation that may hinder maintenance on the set of instruments for the control and monitoring of the operation of the electric pump 10 is produced.

In practice it has been found that the invention achieves the intended aim and objects, a vertical electric pump having been provided which has an expansion tank and elements of the set of instruments for the control and monitoring of its operation which are easily and quickly accessible.

The invention provides a vertical electric pump which, if needed, does not require the user to remember/find information concerning the location of the tank and/or of the elements of the set of instruments for the control and monitoring of its operation.

It should be noted that the invention provides a vertical electric pump which has a smaller space occupation than similar electric pumps of a known type.

The invention thus conceived is susceptible of numerous modifications and variations, all of which are within the scope of the appended claims; all the details may furthermore be replaced with other technically equivalent elements.

In practice, the materials used, so long as they are compatible with the specific use, as well as the contingent shapes and dimensions, may be any according to the requirements and the state of the art.

What is claimed is:

1. A vertical electric pump for moving a liquid, comprising a containment jacket which encloses:

- a mechanical section, which comprises an intake port and a delivery port, said mechanical section containing an assembly for movement of said liquid which comprises one or more impellers, interleaved by diffusers and keyed on a driving shaft, an electromechanical section, comprising an electric motor, which in turn comprises a rotor and a stator that surrounds said rotor, said rotor being keyed on said driving shaft, said electric pump comprising a set of instruments for control and monitoring of operation of said electric pump, wherein said set of instruments for the control and monitoring of the operation of the electric pump is disposed entirely on a single side of said electric pump and accessible from an exterior of said electric pump;

said electric pump further comprising an expansion tank accessible from the single side of said electric pump on which said set of instruments for the control and monitoring of said electric pump is disposed; said electric pump further comprising two pressure sensors:

a first pressure sensor, fluidically connected to said intake port, and a second pressure sensor, fluidically connected to said delivery port;

wherein said set of instruments for the control and monitoring of the operation of said electric pump comprises a user interface, the second pressure sensor, and a one-way valve which is fluidically interposed between said delivery port and said expansion tank.

2. The electric pump according to claim 1, wherein said set of instruments for the control and monitoring of the operation of said electric pump is entirely visible from the single side of said electric pump.

3. The electric pump according to claim 1, wherein said containment jacket has a substantially cylindrical shape; and elements of said set of instruments for the control and monitoring of the operation of said electric pump and said expansion tank are arranged substantially on the same side of said electric pump, said elements of said set of instruments for the control and monitoring of the operation of said electric pump and said expansion tank being proximate to one side of a lateral surface of said containment jacket.

4. The electric pump according to claim 3, further comprising:

a shell which contains at least partially an upper portion of said containment jacket, an enclosure which contains at least partially an upper portion of said expansion tank.

5. The electric pump according to claim 4, wherein said electric pump is provided with a footing, below said containment jacket, which comprises two parallel manifolds adapted to be connected fluidically to a hydraulic system, respectively:

a first manifold, and a second manifold.

6. The electric pump according to claim 5, wherein an axis of extension of each one of said first and second manifolds is substantially parallel to a surface of said shell.

7. The electric pump according to claim 6, wherein the axis of extension of said second manifold is perpendicular to an axis of extension of said containment jacket.

8. The electric pump according to claim 5, wherein said first manifold is connected fluidically to said delivery port and said second manifold is connected fluidically to said intake port.

9. The electric pump according to claim 4, wherein said shell is associated with the lateral surface of said containment jacket and has a substantially flat surface that is parallel to an axis of extension of said containment jacket, said flat surface of said shell accommodating said user interface, said user interface also being substantially flat and parallel to said axis of extension of said jacket.

10. The electric pump according to claim 4, further comprising an electronic board to which said one or more pressure sensors and said user interface are connected electrically, said electronic board being contained in said shell and being substantially parallel to said user interface.

11. The electric pump according to claim 1, further comprising:

a shell which contains at least partially an upper portion of said containment jacket, a lower portion of said containment jacket being external to the shell; and a removable enclosure separate from the shell and adjacent thereto, which contains at least partially an upper portion of said expansion tank, a lower portion of said expansion tank being external to the removeable enclosure.

* * * * *